US006533684B2

(12) United States Patent
Winfield et al.

(10) Patent No.: US 6,533,684 B2
(45) **Date of Patent: *Mar. 18, 2003**

(54) PHYLLOTAXIS-BASED DIMPLE PATTERNS

(75) Inventors: Douglas C. Winfield, Mattapoisett, MA (US); Kevin M. Harris, New Bedford, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/951,727

(22) Filed: Sep. 14, 2001

(65) Prior Publication Data

US 2002/0019275 A1 Feb. 14, 2002

Related U.S. Application Data

(63) Continuation of application No. 09/418,003, filed on Oct. 14, 1999.

(51) Int. Cl.[7] ..... A63B 37/12
(52) U.S. Cl. ..... 473/378
(58) Field of Search ..... 473/378, 383, 473/384, 377

(56) References Cited

U.S. PATENT DOCUMENTS 4,960,283 A * 10/1990 Gobush ..... 273/232
5,060,953 A * 10/1991 Bunger et al. ..... 273/232
5,201,523 A * 4/1993 Miller ..... 473/378
5,842,937 A * 12/1998 Dalton et al. ..... 473/384
6,338,684 B1 * 1/2002 Winfield et al. ..... 473/378

OTHER PUBLICATIONS

Phyllotaxis, A Systemic Study in Plant Morphogenesis, Roger V. Jean, Cambridge University Press, 1994, pp. 11–23, 34, 60, 70, 187 and 217.*

* cited by examiner

*Primary Examiner*—Mark S. Graham
*Assistant Examiner*—Raeann Gorden
(74) *Attorney, Agent, or Firm*—Swidler Berlin Shereff Friedman, LLP

(57) ABSTRACT

Golf balls are disclosed having novel dimple patterns determined by the science of phyllotaxis. A method of packing dimples using phyllotaxis is disclosed. Phyllotactic patterns are used to determine placement of dimples on a golf ball. Preferably, a computer modeling program is used to place the dimples on the golf balls. Either two-dimensional modeling or three-dimensional modeling programs are usable. Preferably, careful consideration is given to the placement of the dimples, including a minimum distance criteria so that no two dimples will intersect. This criterion ensures that the dimples will be packed as closely as possible.

14 Claims, 6 Drawing Sheets

PHYLLOTAXIS-BASED DIMPLE PATTERNS

This application is a continuation of application Ser. No. 09/418,003, filed on Oct. 14, 1999.

FIELD OF THE INVENTION

The present invention is directed to golf balls. More particularly, the present invention is directed to a novel dimple packing method and novel dimple patterns. Still more particularly, the present invention is directed to a novel method of packing dimples using phyllotaxis and novel dimple patterns based on phyllotactic patterns.

BACKGROUND

Dimples are used on golf balls to control and improve the flight of the golf ball. The United States Golf Association (U.S.G.A.) requires that golf balls have aerodynamic symmetry. Aerodynamic symmetry allows the ball to fly with little variation no matter how the golf ball is placed on the tee or ground. Preferably, dimples cover the maximum surface area of the golf ball without detrimentally affecting the aerodynamic symmetry of the golf ball.

Most successful dimple patterns are based in general on three of five existing Platonic Solids: Icosahedron, Dodecahedron or Octahedron. Because the number of symmetric solid plane systems is limited, it is difficult to devise new symmetric patterns.

There are numerous prior art golf balls with different types of dimples or surface textures. The surface textures or dimples of these balls and the patterns in which they are arranged are usually defined by Euclidean geometry.

For example, U.S. Pat. No. 4,960,283 to Gobush discloses a golf ball with multiple dimples having dimensions defined by Euclidean geometry. The perimeters of the dimples disclosed in this reference are defined by Euclidean geometric shapes including circles, equilateral triangles, isosceles triangles, and scalene triangles. The cross-sectional shapes of the dimples are also Euclidean geometric shapes such as partial spheres.

U.S. Pat. No. 5,842,937 to Dalton et al. discloses a golf ball having a surface texture defined by fractal geometry and golf balls having indents whose orientation is defined by fractal geometry. The indents are of varying depths and may be bordered by other indents or smooth portions of the golf ball surface. The surface textures are defined by a variety of fractals including two-dimensional or three-dimensional fractal shapes and objects in both complete or partial forms.

As discussed in Mandelbrot's treatise *The Fractal Geometry of Nature,* many forms in nature are so irregular and fragmented that Euclidean geometry is not adequate to represent them. In his treatise, Mandelbrot identified a family of shapes, which described the irregular and fragmented shapes in nature, and called them fractals. A fractal is defined by its topological dimension $D_T$ and its Hausdorf dimension D. $D_T$ is always an integer, D need not be an integer, and $D \geqq D_T$. (See p. 15 of Mandelbrot's *The Fractal Geometry of Nature*). Fractals may be represented by two-dimensional shapes and three-dimensional objects. In addition, fractals possess self-similarity in that they have the same shapes or structures on both small and large scales. U.S. Pat. No. 5,842,937 uses fractal geometry to define the surface texture of golf balls.

Phyllotaxis is a manner of generating symmetrical patterns or arrangements. Phyllotaxis is defined as the study of the symmetrical pattern and arrangement of leaves, branches, seeds, and pedals of plants. See *Phyllotaxis A Systemic Study in Plant Morphogenesis* by Peter V. Jean, p. 11–12. These symmetric, spiral-shaped patterns are known as phyllotactic patterns. Id. at 11. Several species of plants such as the seeds of sunflowers, pine cones, and raspberries exhibit this type of pattern. Id. at 14–16.

Some phyllotactic patterns have multiple spirals on the surface of an object called parastichies. The spirals have their origin at the center of the surface and travel outward, other spirals originate to fill in the gaps left by the inner spirals. Frequently, the spiral-patterned arrangements can be viewed as radiating outward in both the clockwise and counterclockwise directions. These type of patterns are said to have visibly opposed parastichy pairs denoted by (m, n) where the number of spirals at a distance from the center of the object radiating in the clockwise direction is m and the number of spirals radiating in the counterclockwise direction is n. The angle between two consecutive spirals at their center C is called the divergence angle d. Id. at 16–22.

The Fibonnaci-type of integer sequences, where every term is a sum of the previous other two terms, appear in several phyllotactic patterns that occur in nature. The parastichy pairs, both m and n, of a pattern increase in number from the center outward by a Fibonacci-type series. Also, the divergence angle d of the pattern can be calculated from the series. Id.

When modeling a phyllotactic pattern such as with sunflower seeds, consideration for the size, placement and orientation of the seeds must be made. Various theories have been proposed to model a wide variety of plants. These theories can be used to create new dimple patterns for golf balls using the science of phyllotaxis.

SUMMARY OF THE INVENTION

The present invention provides a method of packing dimples using phyllotaxis and provides a golf ball whose surface textures or dimensions correspond with naturally occurring phenomena such as phyllotaxis to produce enhanced and predictable golf ball flight. The present invention replaces conventional dimples with a surface texture defined by phyllotactic patterns. The present invention may also supplement dimple patterns defined by Euclidean geometry with parts of patterns defined by phyllotaxis.

Models of phyllotactic patterns are used to create new dimple patterns or surface textures. For golf ball dimple patterns, careful consideration is given to the placement and packing of dimples or indents. The placement of dimples on the ball using the phyllotactic pattern are preferably made with respect to a minimum distance criterion so that no two dimples will intersect. This criterion also ensures that the dimples will be packed as closely as possible.

BRIEF DESCRIPTION OF THE DRAWINGS

Reference is next made to a brief description of the drawings, which are intended to illustrate a first embodiment and a number of alternative embodiments of the golf ball according to the present invention.

DETAILED DESCRIPTION

Figure 1A:
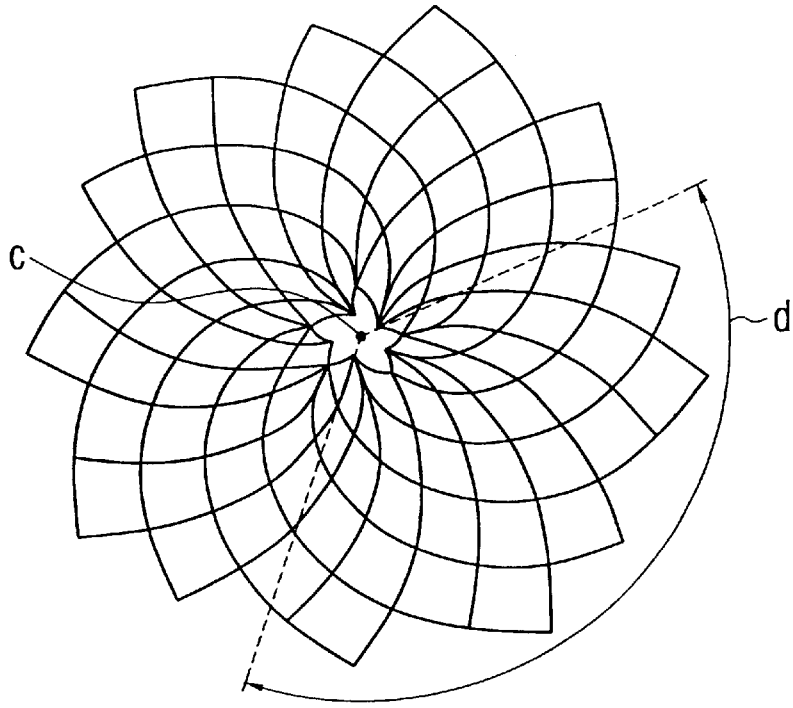
FIG. 1A is a front view of a phyllotactic pattern.
Figure 1B:
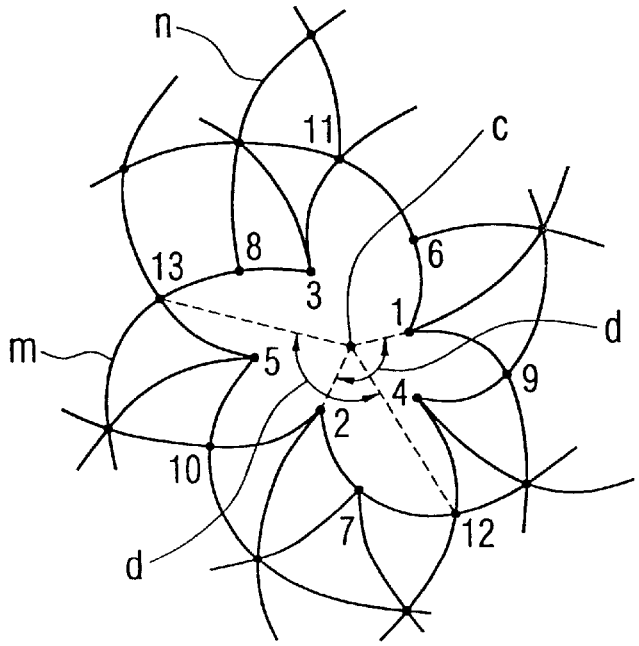
FIG. 1B is a detail of the center of the view of the phyllotactic pattern of FIG. 1A.

Phyllotaxis is the study of symmetrical patterns or arrangements. This is a naturally occurring phenomenon. Usually the patterns have arcs, spirals or whorls. Some phyllotactic patterns have multiple spirals or arcs on the surface of an object called parastichies. As shown in FIG. 1A, the spirals have their origin at the center C of the surface and travel outward, other spirals originate to fill in the gaps left by the inner spirals. See Jean's *Phyllotaxis A Systemic Study in Plant Morphogenesis* at p. 17. Frequently, the spiral-patterned arrangements can be viewed as radiating outward in both the clockwise and counterclockwise directions. As shown in FIG. 1B, these type of patterns have visibly opposed parastichy pairs denoted by (m, n) where the number of spirals or arcs at a distance from the center of the object radiating in the clockwise direction is m and the number of spirals or arcs radiating in the counterclockwise direction is n. See Id. Further, the angle between two consecutive spirals or arcs at their center is called the divergence angle d. Preferably, the divergence angle is less than 180°.

The Fibonnaci-type of integer sequences, where every term is a sum of the previous two terms, appear in several phyllotactic patterns that occur in nature. The parastichy pairs, both m and n, of a pattern increase in number from the center outward by a Fibonacci-type series. Also, the divergence angle d of the pattern can be calculated from the series. The Fibonacci-type of integer sequences are useful in creating new dimple patterns or surface texture.

Important aspects of a dimple design include the percent coverage and the number of dimples or indents. The divergence angle d, the dimple diameter or other dimple measurement, the dimple edge gap, and the seam gap all effect the percent coverage and the number of dimples. In order to increase the percent coverage and the number of dimples, the dimple diameter, the dimple edge gap, and the seam gap can be decreased. The divergence angle d can also affect how dimples are placed. The divergence angle is related to the to Fibonacci-type of series. A preferred relationship for the divergence angle d in degrees is:

$$d = \frac{360}{F_2\left(F_1 + \frac{\sqrt{5}+1}{2}\right)}$$

where $F_1$ and $F_2$ are the first and second terms in a Fibonacci-type of series, respectively. For example, 180° minus d can yield a phyllotactic pattern. Other values of divergence angle d not related to a Fabonacci-type of series could be used including any irrational number. Another relationship for the divergence angle d in degrees is:

$$d = \frac{360}{F_1 + \left(F_2 + \frac{\sqrt{5}+1}{2}\right)^{-1}}$$

where $F_1$ and $F_2$ are the first and second terms in a Fabonacci-type of series, respectively.

Near the equator of the golf ball, it is important to have as many dimples or indents as possible to achieve a high percentage of dimple coverage. Some divergence angles d are more suited to yielding more dimples near the equator than other angles. Particular attention must be paid to the number of dimples so that the result is not too high or too low. Preferably, the pattern includes between about 300 to about 500 dimples. Multiple dimple sizes can be used to affect the percentage coverage and the number of dimples; however, careful attention must be given to the overall symmetry of the dimple pattern. The dimples or indents can be of a variety of shapes, sizes and depths. For example, the indents can be circular, square, triangular, or hexagonal. The dimples can feature different edges or sides including ones that are straight or sloped. In sum, any type of dimple known to those skilled in the art could be used with the present invention.

Figure 1C:
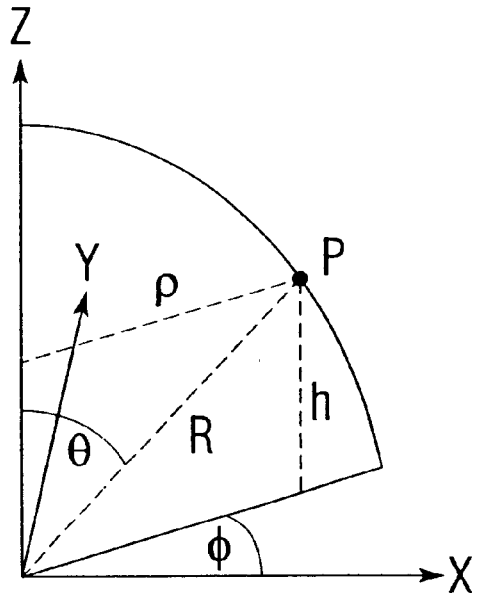
FIG. 1C is a graph illustrating the coordinate system in a phyllotactic pattern.

The coordinate system used to model phyllotactic patterns is shown in FIG. 1C. The XY plane is the equator of the ball while the Z direction goes through the pole of the ball. Preferably, the dimple pattern is generated from the equator of the golf ball, the XY plane, to the pole of the golf ball, the Z direction. The angle $\phi$ is the azimuth angle while $\theta$ is the angle from the pole of the ball similar to that of spherical coordinates. The radius of the ball is R while $\rho$ is the distance of the dimple from the polar axis and h is the distance in the Z direction from the XY plane. Some useful relationships are:

$$x^2+y^2+z^2=R^2=\rho^2+h^2 \tag{1}$$

$$\varphi = \tan^{-1}\left(\frac{Y}{X}\right) = \cos^{-1}\left(\frac{X}{\rho}\right) = \sin^{-1}\left(\frac{Y}{\rho}\right) \tag{2}$$

$$\theta = \tan^{-1}\left(\frac{\rho}{h}\right) \tag{3}$$

In order to model a phyllotactic pattern for golf balls, consecutive dimples must be placed at angle $\phi$ where:

$$\phi_{i+1}=\phi_i+d \tag{4}$$

where i is the index number of the dimple.

Another consideration is how to model the top and bottom hemispheres such that the spiral pattern is substantially continuous. If the initial angle $\phi$ is 0° and the divergence angle is d for the top hemisphere, the bottom hemisphere can start at −d where:

$$\phi_{i+1}=\phi_i-d \tag{5}$$

This will provide a ball where the pattern is substantially continuous.

Figure 1D:
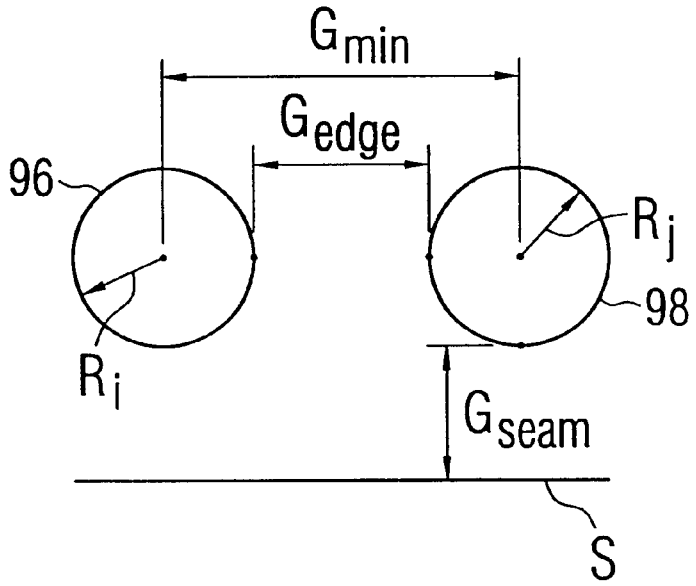
FIG. 1D is a top view of two dimples according to the present invention.

When modeling a phyllotactic pattern such as with sunflower seeds, consideration for the size, placement and orientation of the seeds must be made. Similarly, several special considerations have to be made in designing or modeling a phyllotactic pattern for use as a golf ball dimple pattern. As shown in FIG. 1D, one such consideration is that the minimum gap $G_{min}$, which is the minimum distance between the centers of adjacent dimples 96 and 98, is preferably equal to the radii $R_i$ and $R_j$ of the two dimples plus a distance between the edges of the dimples. If the dimples in the pattern have different radii, the $G_{min}$ will change depending on the radii of the two dimples:

$$G_{min}=R_i+R_j+G_{edge} \tag{6}$$

where $G_{edge}$ is the gap or distance between the dimple edges. The minimum distance between the edges of the dimples is the variable of concern and has a preferable value as low as 0. Although dimples can overlap, it is more preferable that $G_{edge}$ is greater than or equal to about 0.001 inches.

Further, as shown in FIG. 1D, golf ball preferably has a seam S in order to be manufactured, where the dimples do not intersect the seam S. Further, in golf ball manufacture, there is a limit on how close the dimples can come to the seam. Therefore, the phyllotactic pattern starts at an angle $\theta_0$ that is a certain gap $G_{seam}$ from the equator where:

$$G_{seam}+R_{dimple}=R(90°-\theta_0) \tag{7}$$

where R is the radius of the golf ball. The dimples would originate at the equator if $\theta_0$ is equal to 90°. However, it is preferable for the dimples to start at a distance of about 0.003 inches from the equator. Thus, preferably the dimples start just above or below the equator. To determine the starting angle $\theta_0$ the equation is solved for $\theta_0$ with a predetermined $G_{seam}$.

A minimum distance criterion can be used so that no two dimples will intersect or are too close. If the dimple is less than a distance or gap $G_{min}$from another dimple, new coordinates of the dimple or size of the dimple can be found so that it is a distance $G_{min}$ from the other dimple. New values for h and ρ of that dimple can be calculated so that the dimple is still at angle ϕ. The distance or gap G between dimples i and j can be calculated where:

$$G = 2R\sin^{-1}\left(\frac{\sqrt{(x_i-x_j)^2+(y_i+y_j)^2+(z_i-z_j)^2}}{2R}\right) \tag{8}$$

If dimple i is too close to dimple j, then a search for a value of h on $z_i$ can be performed until G is equal to $G_{min}$ using the secant method where h is constrained to be less than R and greater than 0. Once a particular value of h is found, a value of ρ can be found using Equation 1. Then, values of $x_i$ and $y_i$ can be found using Equation 2.

Various divergence angles d can be used to derive a desired dimple pattern. The dimples are contained on the arcs of the pattern. Not all of the arcs extend from the equator to the pole. A number of arcs phase out as the arcs move from the equator to the pole of the hemisphere.

Figure 2:
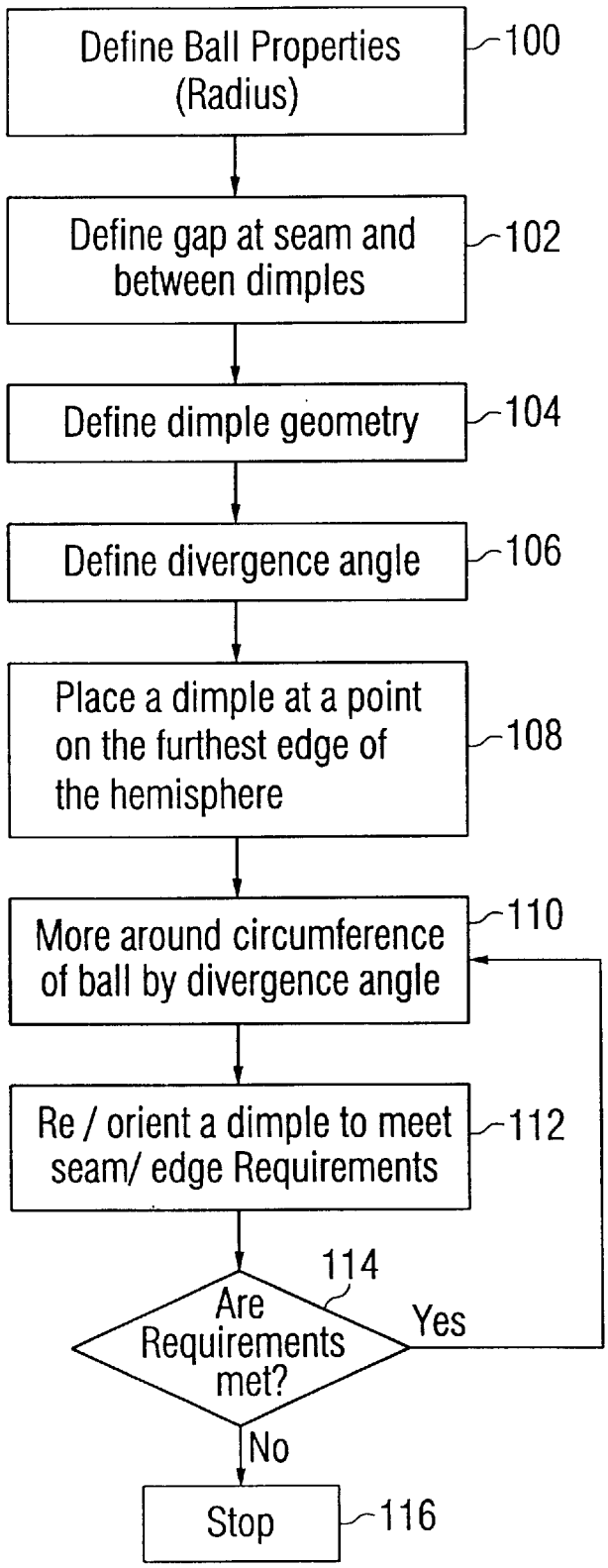
FIG. 2 is a chart depicting the method of packing dimples according to a first embodiment of the present invention.

Preferably, a dimple pattern is generated as shown in FIG. 2. First at step 100, the ball properties are defined by the user. Preferably, the radius of the golf ball is defined during this step. Next at step 102, a seam gap $G_{seam}$ between the hemispheres of the golf ball and a dimple edge gap $G_{edge}$ between dimples are defined using the formulae discussed above. Preferably, the dimple edge gap $G_{edge}$ is equal to or greater than 0.001 inches. The dimple geometry is defined at step 104. The dimples or indents may be of a variety of shapes and sizes including different depths and widths. For example, the dimples may be concave hemispheres, or they may be triangular, square, hexagonal or any other shape known to those skilled in the art of golf balls. They may also have straight, curved or sloped edges or sides. Next at step 106, a divergence angle d is chosen. At step 108, a dimple is placed at a point along the furthest edge of the hemisphere of the golf ball to be modeled. At step 110, another point on the hemisphere of the ball is determined by moving around the circumference of the hemisphere by the divergence angle d. At step 112 a dimple is placed at this point meeting the seam gap $G_{seam}$ and the dimple edge gap $G_{edge}$ requirements. However, if the requirements can not be met at step 114, the process is stopped at step 116. If the seam gap $G_{seam}$ and dimple edge gap $G_{edge}$ requirements can still be met, steps 110–114 are repeated until a pattern of dimples is created from the equator to the pole of the hemisphere of the golf ball. When dimples are placed near the pole of the hemisphere it will become impossible to place more dimples on the hemisphere without violating the dimple edge gap criterion; thus, step 116 is reached and the process is stopped.

This method of placing dimples can also be used to pack dimples on a portion of the surface of a golf ball. Preferably, the golf ball surface is divided into sections or portions defined by translating a Euclidean or other polygon onto the surface of the golf ball and then packing each section or portion with dimples or indents according to the phyllotactic method described above. For example, this method of packing dimples can be used to generate the dimple pattern for a portion of a typical dodecahedron or icosahedron dimple pattern. Thus, this method of packing dimples can be used to vary dimple patterns on typical symmetric solid plane systems. The section or portion of the ball is first defined, and preferably has a center and an outer perimeter or edge. The method according to FIG. 2 is followed except that the dimples or indents are placed from the outer perimeter or edge of the section or portion toward the center to form the pattern. The dimple edge gap and dimple seam gap are used to prevent the overlapping of dimples within the section or portion, between sections or portions, and the overlapping of dimples on the equator or seam between hemispheres of the golf ball.

Figure 3:
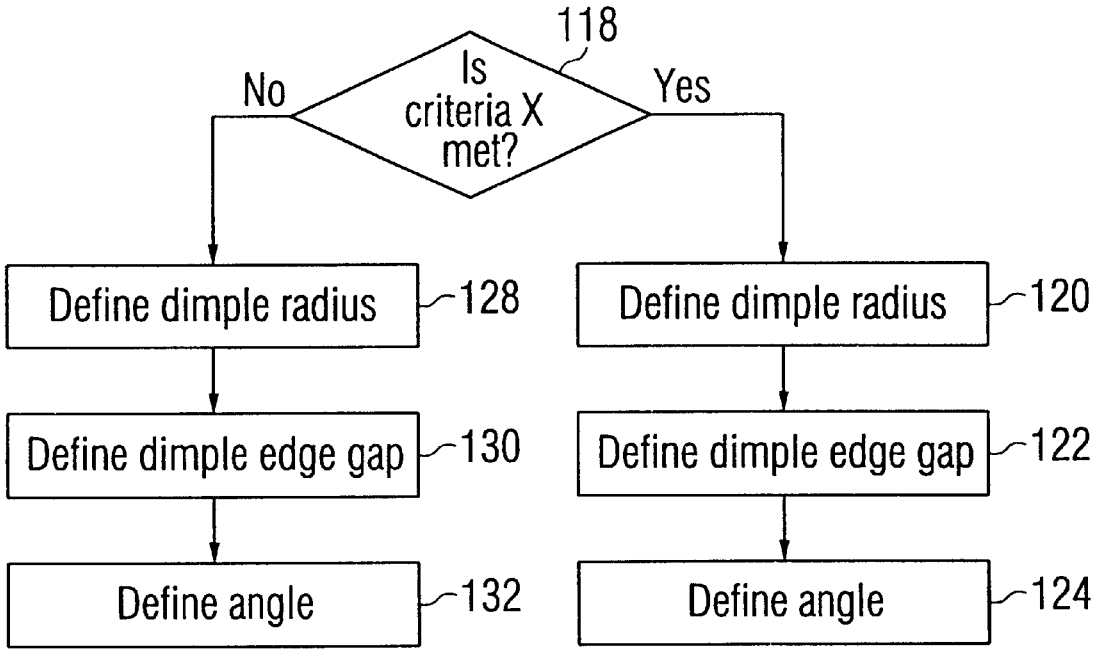
FIG. 3 is a chart depicting the method of packing dimples according to a second embodiment of the present invention.
Figure 6:
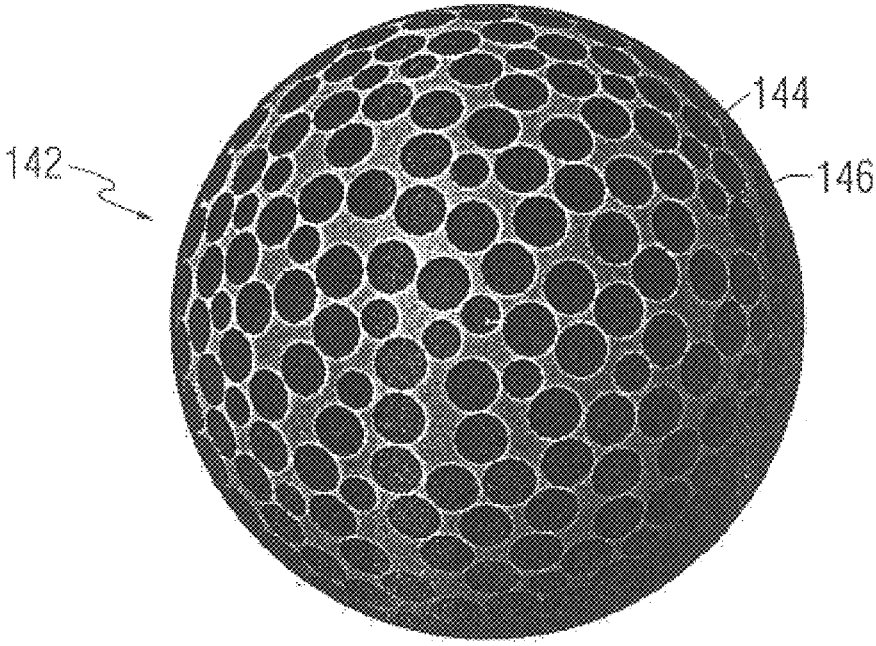
FIG. 6 is a golf ball having a dimple pattern defined by a phyllotactic pattern according to the present invention.
Figure 7:
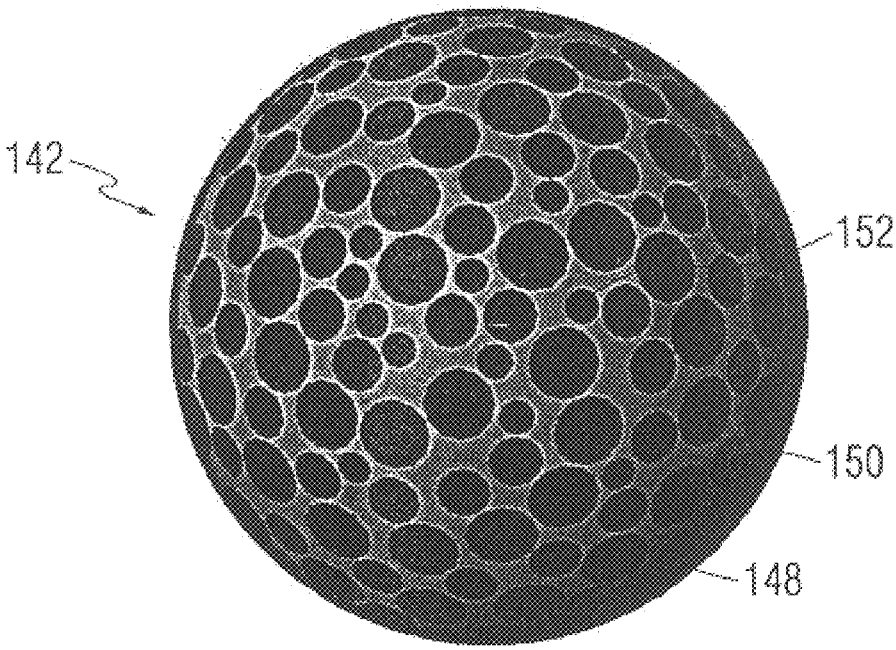
FIG. 7 is a golf ball having a dimple pattern defined by a phyllotactic pattern according to the present invention.

As shown in FIGS. 6 and 7, various dimple sizes can be used in the dimple patterns. To generate a dimple pattern with different sized dimples, more than one dimple size is defined and each size dimple is used when certain criteria are met. As shown in FIG. 3, if a certain criterion X in step 118 is met, then a first dimple is used having a certain defined criterion including a dimple radius or other dimple or indent measurement, dimple edge gap $G_{edge}$, angle and dimple number that are defined at steps 120, 122 and 124 for that criterion X. If this criterion X is not met, then a second size dimple with its own defined set of dimple radius or other dimple or indent measurement, dimple edge gap $G_{edge}$, angle and dimple number that are defined in steps 128, 130 and 132 is used. Various levels of criterion can be used so that there will be two or more dimple sizes within the dimple pattern. The criterion can be based on different criterion including loop counts through the program, dimple number or any other suitable criterion. Preferably, steps 118–132 are used between steps 108 and 114 of the method shown in FIG. 2.

Figure 4:
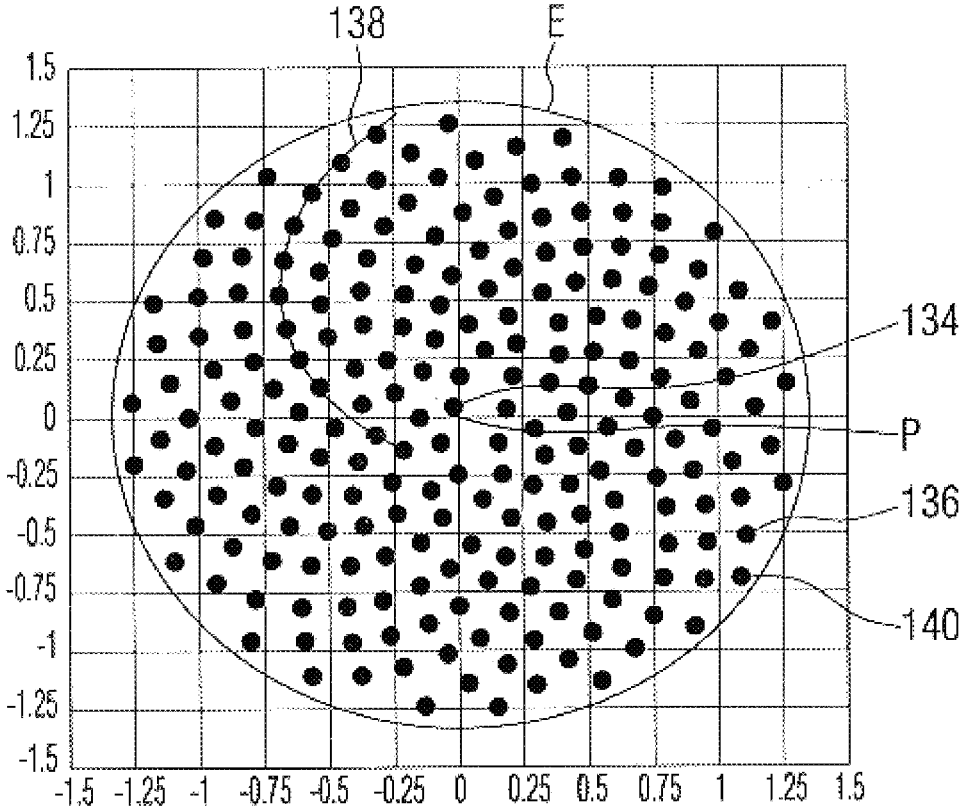
FIG. 4 is a two-dimensional graph illustrating a dimple pattern based on the present invention.

Preferably, computer modeling tools are used to assist in designing a phyllotactic dimple pattern defined using phyllotaxis. As shown in FIG. 4, a first modeling tool gives a two-dimensional representation of the dimple pattern. If the pole P is considered the origin 134, the dimples 136 are placed away from the origin starting at the seam or Equator E on an arc 138 at a distance equal to Rθ until the origin of the golf ball is reached. Preferably, the program also prints out the number of dimples and the percent coverage, and gives a quick visual perspective on what the dimple pattern would look like. A sample output is shown in FIG. 4.

Figure 5:
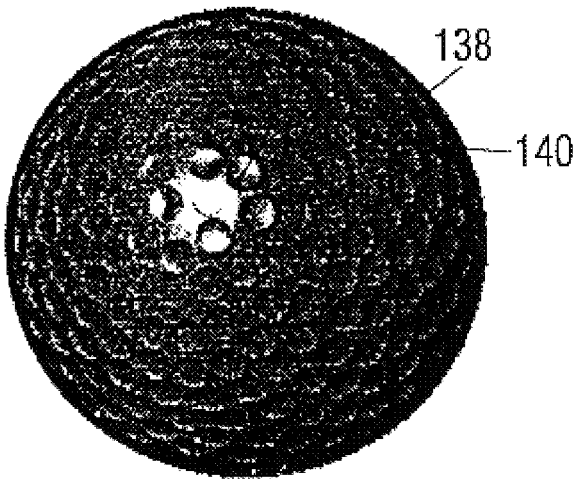
FIG. 5 is a three-dimensional view of a golf ball having a dimple pattern defined by a phyllotactic pattern according to the present invention.

As shown in FIG. 5, a second computer modeling tool gives a three-dimensional representation of the ball. The dimple pattern is drawn in three-dimensions. The pattern is made by generating the arcs 138 and placing the dimples 136 on the arcs 138 as they are generated. This is done until the pole of the hemisphere of the golf ball is reached. One can either draw a hemisphere or draw the entire ball while placing the dimples. A sample output is shown in FIG. 5.

Preferably, because of the algorithm described above, intersecting dimples rarely occur when using the method to generate a dimple pattern. Thus, the patterns do not often need to be modified by a person using the program. The modeling program preferably generates the spiral pattern from the divergence angle d. The dimples 136 are placed on the arcs 138 as they are generated by the modeling program as described above with regard to FIG. 2. Preferably, the pattern is generated from the equator up to the pole of the hemisphere.

Preferably, if one draws the top hemisphere, copies it and, then joins them together on the polar axes, the X axes, as shown in FIG. 1C, of each hemisphere must be offset an angle such as angle d from each other. This will achieve the same effect of modeling the top and bottom hemispheres separately. Other offset angles between hemispheres can also create aesthetic patterns.

As shown in FIGS. 4 and 5, dimple patterns can be created using two-dimensional or three-dimensional modeling program resulting in a dimple pattern that follows a selected phyllotactic pattern. For example, in FIG. 4 a dimple pattern is shown generated in two-dimensions. The dimple pattern features only one size dimple 140. FIG. 5 shows the same dimple pattern as generated in a three-dimensional model. Preferably, as shown in FIGS. 4 and 5, the dimple pattern has a divergence angle d of about 110 to about 170 degrees, a dimple radius of about 0.04 to about 0.09 inches, a percent coverage of about 50 to about 90 percent, and about 300 to about 500 dimples. More preferably, the dimple pattern has a divergence angle d of about 115 to about 160 degrees, a dimple radius of about 0.05 to about 0.08 inches, a percent coverage of about 55 to about 80 percent, and about 350 to about 475 dimples. Most preferably, the dimple pattern has a divergence angle d of about 135 to about 145 degrees, a dimple radius of about 0.06 to about 0.07 inches, a percent coverage of about 60 to about 70 percent, and about 435 to about 450 dimples.

FIGS. 6 and 7 show dimple patterns that use more than one size dimple 136 as generated using the method described in FIGS. 2 and 3. FIG. 6 shows a golf ball 142 featuring a dimple pattern with two differently sized dimples 144 and 146 and a divergence angle d of about 140 degrees. Each of these patterns shows that various dimple patterns can be made and tested to derive dimple patterns that will improve golf ball flight. FIG. 7 shows a golf ball 142 featuring a dimple pattern with three differently sized dimples 148, 150 and 152 and a divergence angle d of about 115 degrees.

While it is apparent that the illustrative embodiments of the invention herein disclosed fulfills the objectives stated above, it will be appreciated that numerous modifications and other embodiments may be devised by those skilled in the art. For example, a phyllotactic pattern can be used to generate dimples on a part of a golf ball or creating dimple patterns using phyllotaxis with the geometry of the dimples generated using fractal geometry. Therefore, it will be understood that the appended claims are intended to cover all such modifications and embodiments which come within the spirit and scope of the present invention.

What is claimed:

1. A golf ball having an outer surface comprising:

a plurality of indents;

wherein placement of at least a portion of the plurality of indents are defined by phyllotactic generated arcs, and wherein a plurality of the arcs extend from indents located near an equator of the golf ball, and wherein at least one of the plurality of arcs terminates in a different location than other arcs.

2. The golf ball of claim 1, wherein substantially all of the indents are defined by the phyllotactic pattern.

3. The golf ball of claim 1, wherein at least one indent is a different size than another indent.

4. The golf ball of claim 2, wherein the indents are placed on arcs of the phyllotactic pattern.

5. The golf ball of claim 4, wherein the phyllotactic pattern includes parastichy pairs m and n.

6. The golf ball of claim 5, wherein m includes the arcs in a clockwise direction.

7. The golf ball of claim 5, wherein n includes the arcs in a counterclockwise direction.

8. The golf ball of claim 1, wherein a plurality of the indents are located on the equator of the golf ball.

9. The golf ball of claim 1 wherein the golf ball includes between about 300 and 500 indents.

10. The golf ball of claim 9, wherein the indents are rounded dimples.

11. The golf ball of claim 10, wherein the indents have a width and a depth, and the width and depth of each indent are substantially the same.

12. The golf ball of claim 10, wherein the indents have a plurality of widths and depths.

13. A golf ball having an outer surface comprising:

a plurality of indents;

wherein placement of at least a portion of the plurality of indents are defined by a phyllotactic pattern originating from an equator of the golf ball by locating a plurality of the indents near the equator of the golf ball, and wherein at least some of the indents form an arc that extends away from the equator and terminates before reaching a pole of the golf ball.

14. The golf ball of claim 13, wherein a plurality of the indents are placed on arcs of the phyllotactic pattern wherein consecutive indents are placed at an angle $\phi$ where $\phi_{i+1}=\phi_i+d$, wherein d is the divergence angle and the initial $\phi$ is 0°.

* * * * *